US008656664B2

(12) United States Patent
Glass et al.

(10) Patent No.: US 8,656,664 B2
(45) Date of Patent: Feb. 25, 2014

(54) ASSEMBLY AND METHOD FOR SECURING AN OPENING OF A BUILDING STRUCTURE

(75) Inventors: James D. Glass, Algonquin, IL (US); William F. Laubach, Elk Grove Village, IL (US)

(73) Assignee: Door & Window Guard Systems, Inc., Inverness, IL (US)

( * ) Notice: Subject to any disclaimer, the term of this patent is extended or adjusted under 35 U.S.C. 154(b) by 0 days.

(21) Appl. No.: 13/290,595

(22) Filed: Nov. 7, 2011

(65) Prior Publication Data

US 2013/0111832 A1 May 9, 2013

(51) Int. Cl.
*E06B 3/26* (2006.01)

(52) U.S. Cl.
USPC ..... 52/202; 49/57

(58) Field of Classification Search
USPC ..... 52/202, 203; 49/50, 57
See application file for complete search history.

(56) References Cited

U.S. PATENT DOCUMENTS

| | | | | | |
|---|---|---|---|---|---|
| 2,549,661 | A * | 4/1951 | Carney | 52/202 |
| 2,622,285 | A * | 12/1952 | Roos | 52/202 |
| 2,772,447 | A * | 12/1956 | Preston | 49/464 |
| 4,938,154 | A * | 7/1990 | Watt | 109/49.5 |
| 5,207,022 | A * | 5/1993 | Watt | 49/50 |
| 5,335,452 | A * | 8/1994 | Taylor | 49/463 |
| 5,683,123 | A * | 11/1997 | Ruoss | 292/57 |
| 5,722,206 | A * | 3/1998 | McDonald | 52/202 |
| 5,832,671 | A | 11/1998 | White | |
| 5,832,758 | A | 11/1998 | White | |
| 5,937,593 | A | 8/1999 | White | |
| 6,115,977 | A * | 9/2000 | Hornberger et al. | 52/238.1 |
| 6,205,713 | B1 * | 3/2001 | Thompson et al. | 49/465 |
| 7,775,002 | B2 * | 8/2010 | Puchniak | 52/202 |
| 7,908,803 | B2 * | 3/2011 | Puchniak | 52/202 |
| 8,046,967 | B2 * | 11/2011 | Suare et al. | 52/506.06 |
| 8,490,346 | B2 * | 7/2013 | Wedren | 52/202 |

FOREIGN PATENT DOCUMENTS

| | | | | |
|---|---|---|---|---|
| GB | 2160248 A | * | 12/1985 | E06B 9/00 |
| GB | 2270336 A | * | 3/1994 | E06B 9/01 |
| GB | 2277548 A | * | 11/1994 | E06B 5/10 |

OTHER PUBLICATIONS

Brochure, "National Arson Prevention Initiative board up procedures," U.S. Fire Administration (2003).

* cited by examiner

*Primary Examiner* — Brent W Herring
(74) *Attorney, Agent, or Firm* — Barnes & Thornburg LLP

(57) ABSTRACT

An assembly for securely enclosing a window, door or other opening defined by a structure of a house or other building comprising: a panel sized to substantially cover the opening and engage the structure, the panel having a face having a front and a back and a pair of lateral sides; one or more mounting bars for securing to the panel; one or more installation bars; means for engaging the panel and the structure to securely enclose the opening. The engaging means configured to secure together one of the mounting bars and one of the installation bars and to move the one or more installation bar towards the back of the panel engage and secure the structure between the panel and the first installation bar. A method for installing the panel to the structure of the building to securely enclose the opening.

26 Claims, 5 Drawing Sheets

ASSEMBLY AND METHOD FOR SECURING AN OPENING OF A BUILDING STRUCTURE

The present disclosure relates to an assembly and method for securing a window or door opening or other opening of a building.

BACKGROUND

Abandoned, vacant, fire damaged, or buildings undergoing rehab are often targets for trespassers and for criminal or dangerous activity because, among other reasons, such structures typically include windows and doors which allow ready entry and egress into the structures. It typically is difficult, if not impossible, to adequately secure the windows and doors or to otherwise keep trespassers from being readily able to break and enter into such structure through the windows or doors using wood, dogs or guards. Not only can criminal or other dangerous activity of trespassers detrimentally impact the value of the property, it also creates significant liability risks to the property owners and public safety personnel and causes a drain on public safety personnel through the need to patrol, nuisance calls, and fires.

A common way to secure the windows and doors of abandoned or vacant homes is by securing wooden boards to the windows and doors. Such securing efforts have inherent disadvantages. For example, the removal of one or more of the wood screws from one opening may be sufficient to unsecure the entire building. Further, as time passes, the wooden boards and the hardware or securing means becomes weather beaten. Further, such securing efforts tend to result in neighborhood "eyesores" as the wooden boards lack aesthetics.

The economic down turns of the last decade in conjunction with the collapse of the real estate market has created thousands, if not hundred of thousands, of abandoned or vacant houses, dwellings, commercial buildings or other structures that are unsecured from criminal removal of items therein, including appliances, windows, furnaces, copper pipe, copper tube, copper wire, etc. Additionally, because such structures typically become abandoned or vacated due to poor economic circumstances, it follows that the funds available to secure or protect such abandoned or vacant structures from trespassers and criminal activity typically are substantially limited.

SUMMARY

The present disclosure relates to an assembly for securely enclosing a window or door opening or other opening defined by a wall or other structure of a house or other building. The assembly comprises a panel sized to substantially cover the opening and engage the structure, the panel having a face having a front and a back and a pair of sides; at least one mounting bar for securing to the panel; at least one installation bar for securing to the mounting bar; and means for engaging the panel and the structure to securely enclose the opening. The engaging means is configured to secure together the mounting bar and the installation bar and to facilitate movement of the installation bar toward the back of the panel to engage and secure the structure between the installation bar and the panel.

The engaging means may be in any suitable form. In an embodiment of the present disclosure, for example, the mounting bar defines a mounting bar hole and the installation bar defines a installation bar hole configured to align with the mounting bar hole, and the engaging means comprises a threaded rod for extending through the first mounting bar and installation bar holes. The engaging means may also includes nuts and washer for facilitating moving the installation bar toward the panel, and may also include a pad to protect the inside of the structure and a pair of set screws for securing the mounting bar to the panel before advancing the installation bar toward the back of the face of the panel. The engaging means may also include engagement tabs in the form of teeth or the like formed on the panel for engaging the ends of the mounting bar.

The panel may be secured to the structure such that the face of the panel defines an outside of the building and an inside of the building. The front of the panel faces the outside of the building and the back of the panel faces the inside of the building. The one or more mounting bars and the one or more installation bars are disposed entirely inside of the building.

The present disclosure is also directed to a method for installing the panel to the structure to securely enclose the opening. The method may include securing the one or more mounting bars to the panel adjacent a back of the panel; securing one of the installation bars to each of the mounting bars with at least one threaded rod received by aligned slots of one of the mounting bar and one of the installation bars so that the panel is on one side of the structure and the installation bar is on the other side of the structure; and moving the installation bar toward the panel until the structure is engaged by the panel and the installation bar.

Features and advantages of the disclosure will be set forth in part in the description which follows and the accompanying drawings described below, wherein one or more embodiments of the disclosure is described and shown, and in part will become apparent upon examination of the following detailed description taken in conjunction with the accompanying drawings.

BRIEF DESCRIPTION OF THE DRAWINGS

The present disclosure and the advantages thereof will become more apparent upon consideration of the following detailed description when taken in conjunction with the accompanying drawings.

DETAILED DESCRIPTION

Figure 1:
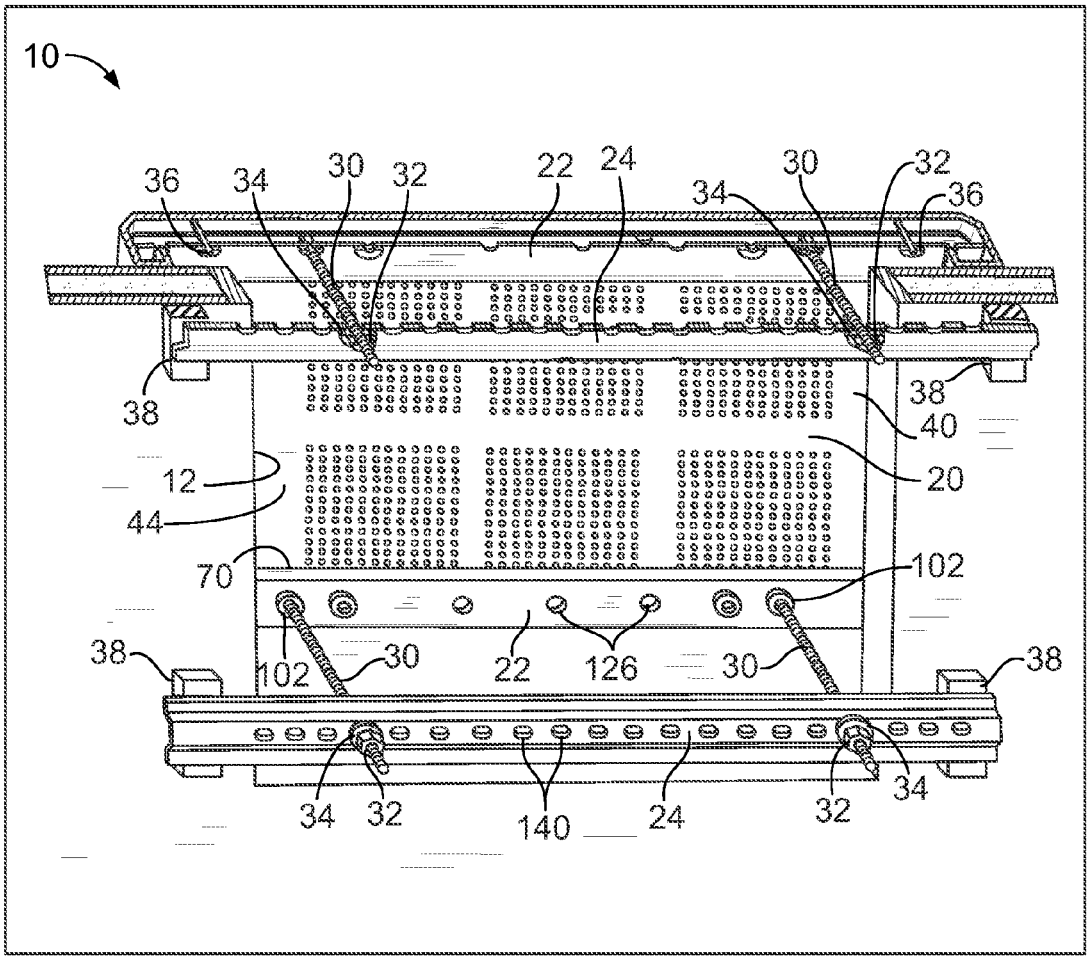
FIG. 1 is a perspective and broken view taken from an inside of a house of an assembly in accordance with an illustrated embodiment of the present disclosure shown secured over a window opening to enclose the window opening.
Figure 2:
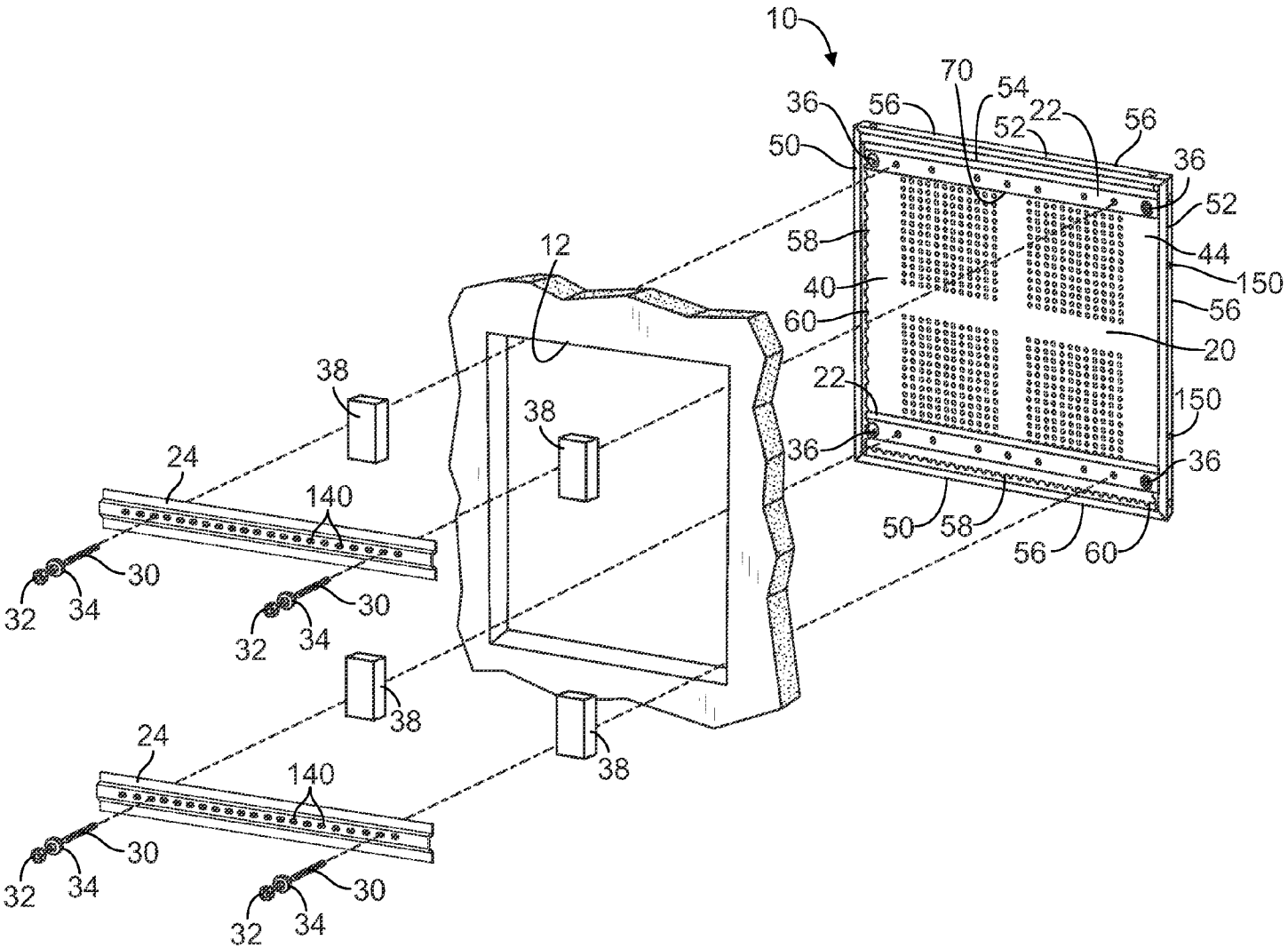
FIG. 2 is an exploded view of the assembly of FIG. 1.
Figure 6:
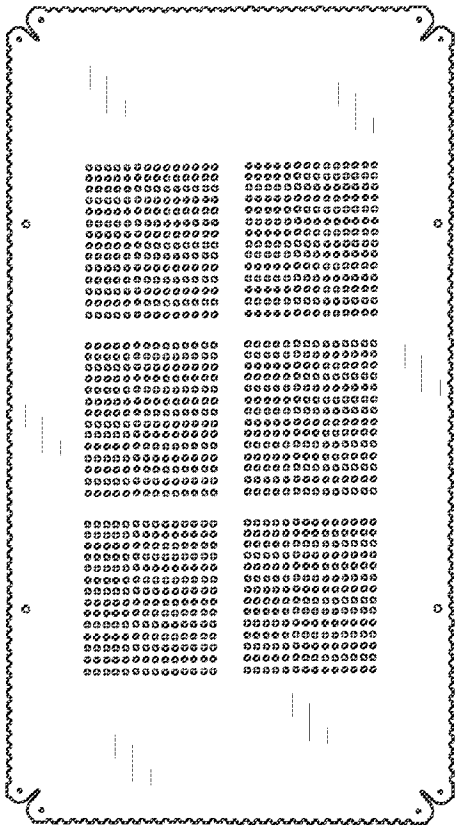
FIG. 6 is a plan view of a steel sheet before it is formed into the panel of the assembly of FIG. 1.
Figure 5:
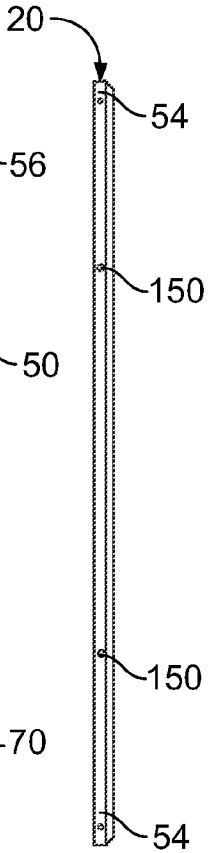
FIG. 5 is a plan view of the lateral side of the panel of the assembly of FIG. 1.
Figure 4:
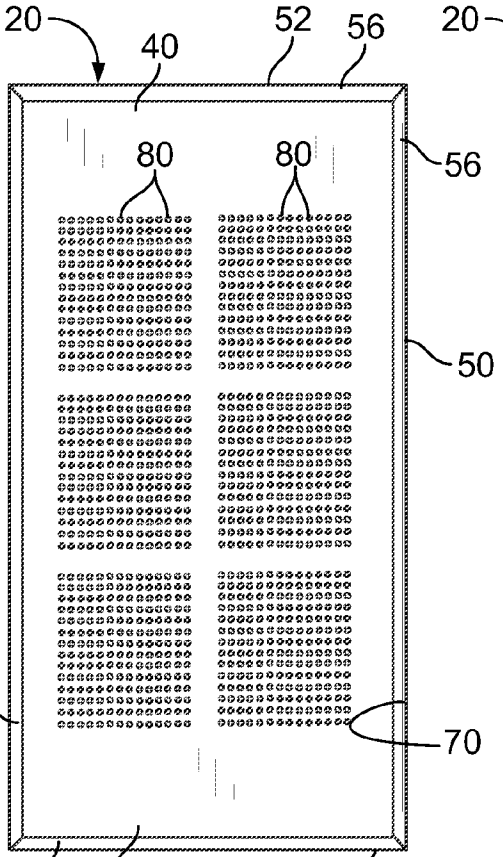
FIG. 4 is a plan view of the back of the panel of the assembly of FIG. 1.
Figure 3:
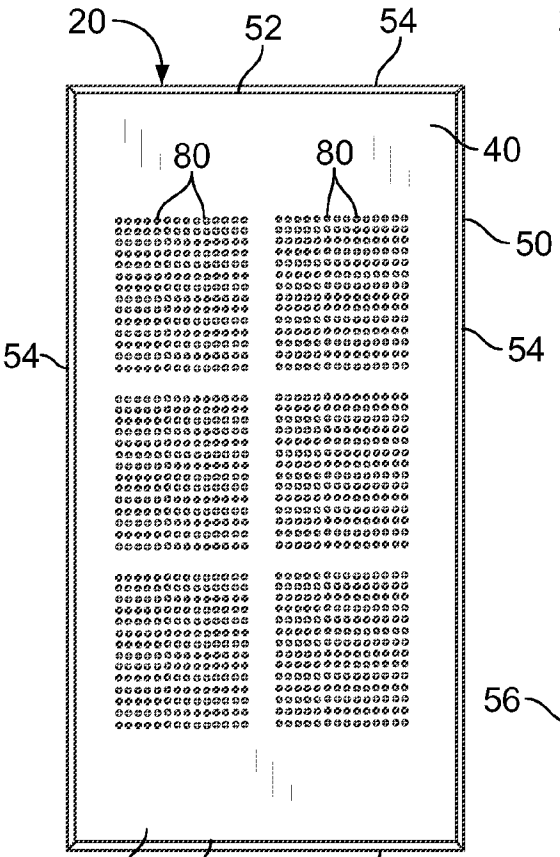
FIG. 3 is a plan view of the front of the panel of the assembly of FIG. 1.
Figure 7:
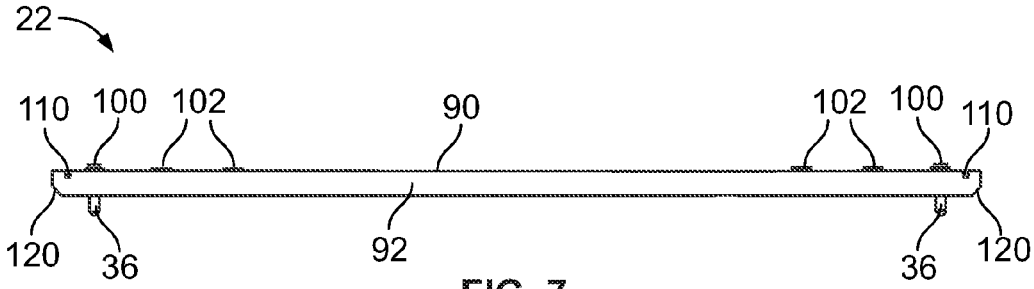
FIG. 7 is a plan view of the side of the mounting bar of the assembly of FIG. 1.
Figure 8:
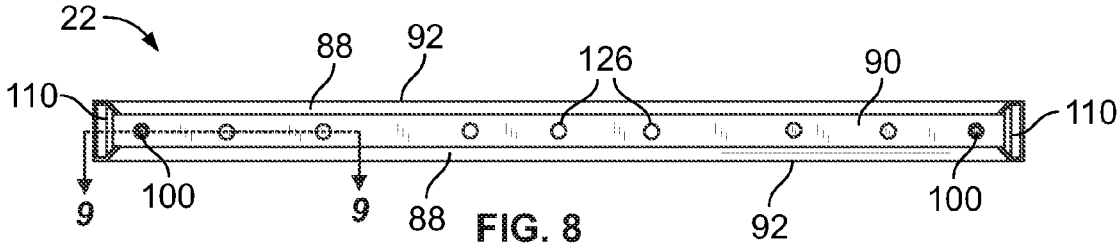
FIG. 8 is a plan view of the bottom of the mounting bar of FIG. 7.
Figure 9:
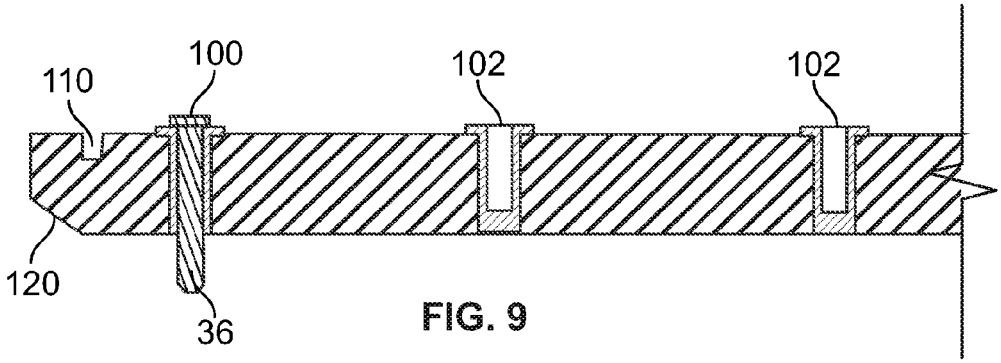
FIG. 9 is a partial section view taken along lines 9-9 of the mounting bar of FIG. 7.
Figure 10:
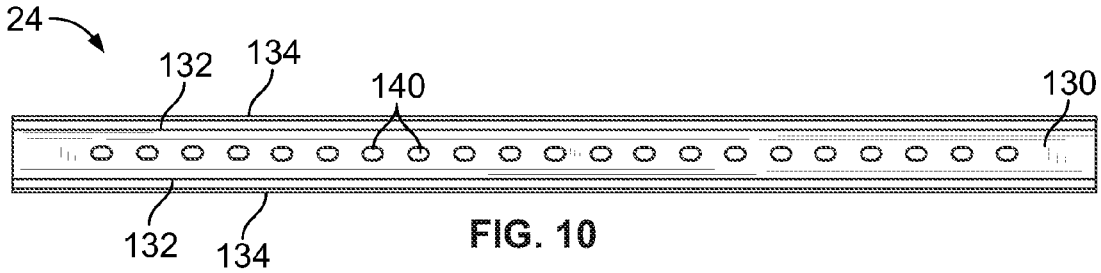
FIG. 10 is a plan view of the back of the installation bar of the assembly of FIG. 1.
Figure 11:
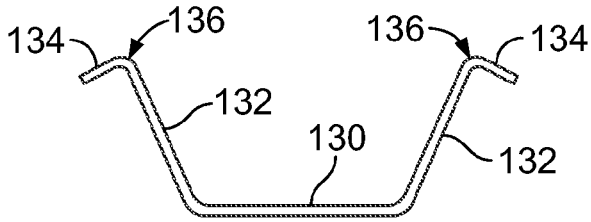
FIG. 11 is a plan view of one end of the installation bar of FIG. 10.
Figure 12:
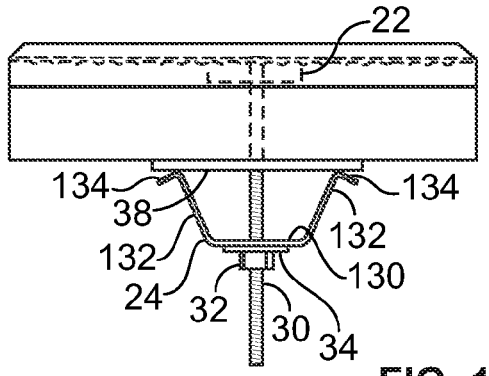
FIG. 12 is a partial end view of installation bar and the pad of the assembly of FIG. 1.

FIGS. 1-12 illustrate an assembly 10 for enclosing a window opening 12 of a house comprising generally a panel 20, a pair of mounting bars 22 securable to the panel 20, a pair of installation bars 24 securable to the mounting bars 22, two pairs of threaded rods 30, two pairs of tamper proof nuts 32, two pairs of washers 34, two pairs of set screws 36, and two pairs of pads 38. The illustrated assembly 10 may be used to secure the panel 20 to a wall or other structure of the house over the window opening 12 to enclose and secure the window opening to prevent or substantially reduce the ability of a trespasser to enter the house through the window opening. FIG. 1 illustrates the assembly 10 being used to enclose a window opening of a house but the assembly can be used to enclose a door opening or any other opening of a house, building or other structure.

The illustrated panel 20 comprises a face 40 having a front 42 and a back 44, a pair of lateral sides 50, a pair of longitudinal sides 52, two pairs of angled members 54, two pairs of contact surfaces 56 for engaging one side of the wall, and two pairs of internal rims 58 each having a series of engagement tabs 60. The lateral and longitudinal sides 50 and 52 define a cavity 70 for receiving the mounting bars 22 adjacent the back 44 of the panel 20. The lateral and longitudinal sides 50 and 52 extend around the perimeter of the panel 20 and comprise a wall extending substantially perpendicular to the face 40 and substantially perpendicular to the wall of the house when the panel 20 is secured to the house. Each angled member 54 interconnects the face 40 with a respective one of the lateral sides 50 or one of the longitudinal sides 52 along the respective lateral or longitudinal side. The angled members 54 provide aesthetic value to the panel 20 and also provide added strength and rigidity to the panel 20. In the illustrated embodiment, each angled member 54 extends on an angle of about 45 degrees from the respective lateral or longitudinal side.

Each contact surface 56 interconnects one of the internal rims 58 with a respective one of the lateral sides 50 or one of the longitudinal sides 52 along the length of the lateral or longitudinal side and also extends inwardly and substantially perpendicular to the respective lateral or longitudinal side. The contact surfaces 56 engage the outside of the wall when the panel 20 is secured to the wall. The internal rims 58 extend substantially perpendicular to the contact surfaces 56 back towards the back 44 of the panel 20. Each of the internal rims 58 includes a series of engagement tabs 60 along its length for engaging the mounting bars 22 as hereinafter described. The engagement tabs 60 may be in the form of teeth or have any other suitable structure.

The illustrated panels 20 may be fabricated from 16 gage cold rolled steel sheets or any other suitable steel or other material. The blank sizes are punched in a turret press and then formed in a brake presses. Each end of each lateral side 50 is welded to one of the ends of one of the longitudinal members 52, each end of each contact surface 56 is welded to one of the ends of one of the other contact surfaces 56, and each end of each internal rim 58 is welded to one of the end of one of the other internal rims 58. Such welding provides additional security and integrity because it eliminates pry slots or similar slots or openings that can be used to separate the adjacent pieces of the panel 20 to gain access into the house.

Patterns of holes 80 may be punched into the face 40 of the panel 20 to allow light into the house. The panels 20 may be powder-coated with an anti-corrosive, UV-resistant coating. The panels 20 may be comprised of any other material and may be constructed in any other manner in accordance with other embodiments of the present disclosure.

The panels 20 may have any suitable size and configuration depending upon the size and configuration of the openings to be enclosed. The panels 20 may, for instance, come in four basic widths of 20", 30", 40", and 50" and may have heights in the range of 20"-100", which typically will cover most common sizes of window openings. The panels 20 may be about two inches tall around all four sides. The illustrated panels 20 are symmetrical in both the X and Y axes. The illustrated panels 20 are substantially rectangular but may have any other suitable configuration in accordance with other embodiments of the present disclosure. If the panel 20 is square, either pair of sides would comprise the lateral sides 50 or the longitudinal sides 52. The face 40, the lateral and longitudinal sides 50 and 52, the contact surfaces 56, and the internal rims 58 may have any other suitable construction and configuration in accordance with other embodiments of the present disclosure.

The illustrated mounting bars 22 are long formed steel fabricators that have a generally U-cross section with a pair of opposed engaging surfaces 88 along the length of the mounting bars 22. Thus, the mounting bars 22 include a base 90, a pair of opposed walls 92 disposed about and extending substantially perpendicular to the base, and the pair of engaging surfaces 88 disposed along the opposed walls opposite the base extending substantially perpendicular to the opposed walls. Each mounting bar 22 has a pair of open rivet nuts 100 for receiving and threadingly engaging the set screws 36 and two pairs of closed rivet nuts 102 for receiving and threadingly engaging the threaded rods 30 at the selected location, and defines a pair of transverse slots 110 adjacent its ends for engaging the engagement tabs 60 of the internal rims 58 of the panel 20 within the cavity 70 of the panel 20 at a selected position along the length of the internal rims 58. There may be one or more additional pairs of open rivet nuts 100 and closed rivet nuts 102 for selective engagement of the set screws 36 and threaded rods.

The mounting bars 22 engage the panel 20 by receiving the engagement tabs 60 of opposed internal rims 58 in the transverse slots 110 and interlocking with the engagement tabs 60. Because the engagement tabs 60 extend along the length of the lateral and longitudinal sides 50 and 52, the mounting bars 22 can be engaged at any suitable location adjacent the back 44 of the panel 30. The set screws 36 can then be used to engage the back 44 of the panel 20 to secure the mounting bar 22 in place on the panel 20 during assembly 10 to prevent slippage. The engaging surfaces 88 of the mounting bars 22 may help position the mounting bars 22 on the back 44 of the face 40 of the panel 20 during assembly 10. The illustrated mounting bar 22 also includes angled surfaces 120 to complement the angled members 54 of the panels 20 during assembly 10. The mounting bars 22 are sized to be received within the cavity 70 defined by the panel 20 and to interlock with the engagement tabs 60 of the panel 20. Each mounting bar 22 defines a series of spaced holes 126 spaced along its length for receiving the open rivet nuts 100 or the closed rivet nuts 102 or to otherwise provide additional holes for receiving open or closed rivet nuts. The mounting bars 22 may be fabricated from 16 gage pre-galvanized steel sheets or other suitable steel or other material. The blank sizes are punched in a turret press, then formed in a brake press.

The illustrated installation bars 24 comprise a long formed steel extrusion comprising an elongated securing member 130, a pair of elongated walls 132 interconnected with and disposed about the elongated securing member, a pair of elongated flanges 134 interconnected with and disposed about the elongated walls, and a pair of elongated radius portions 136 interconnecting the walls 132 and flanges 134. The elongated securing member 130 defines a series of spaced elongated slots 140 spaced along its length for aligning with the holes 126 of the mounting bars 22. Each elongated wall 132 extends at an angle relative to the elongated mounting member in the range of about 30 degrees. Each elongated flange 134 extends outward from a respective elongated wall at an angle of about 90 degrees. The elongated radius portions 136 are configured to engage the wall inside the house when the panel is secured to the wall inside the house. The elongated radius portions and the elongated walls 132 and flanges 134 provide rigidity along the length of the installation bar 24. In accordance with other embodiments of the present disclosure, installation bars 24 can instead be inverted such that the securing members 130 engage the wall inside the house.

The installation bar 24 may be 30"-60" long or any other length depending upon the window opening 12 or other opening. The installation bars 24 may be formed steel parts and may, for example, be fabricated from 16 gage pre-galvanized steel sheets or any other suitable steel or other material. The blank sizes may be punched in a turret press and then formed in a brake press.

In the illustrated embodiment of the present disclosure, a pair of the mounting bars 22 are secured to or otherwise adjacent the back 44 of the panel 20 and a pair of the installation bars 24 are secured to the mounting bars. In accordance with other embodiments of the present disclosure, any number of mounting bars 22 and installation bars 24 may be used to secure the panel 20 to the wall of the house.

The illustrated pads 38 are configured to be disposed between the wall of the house and the elongated radius portions 136 or the other portion of the installation bars 24 that engage the inside of the wall of the house when the panel 20 is secured to the outside of the wall to prevent or minimize damage to the inside of the wall that otherwise may be caused by the installation bars 24 when the panel 20 is secured to the structure. The illustrated pads 38 have a generally rectangular configuration and may be constructed of high durometer rubber. The illustrated pads 38 may have a dimension of 2"×4"×¼". The pads 38 may have any other suitable configuration and size and may be constructed of any other suitable rubber or non-rubber material in accordance with other embodiments of the present disclosure.

The tamper proof nuts 32 may be round, angled face nuts 32 with symmetrical facets in the X and Y planes. Depending upon the application, a special driver may be needed to interface and fasten and unfasten the nuts 32. The tamper proof nuts 32 are sized to threadingly engage threaded rods 30. The tamper proof nuts 32 may be any other type of nut, hardware or securing structure in accordance with other embodiments of the present disclosure.

The assembly 10 in accordance with the present disclosure also includes means for engaging the panel 20 and the wall to securely enclose the window opening 12. The engaging means secures together each of the mounting bars 22 with a respective one of the installation bars 24 and defines a pair of gaps between the panel 20 and the installation bar 24 for receiving the wall. The engaging means comprises the two pairs of threaded rods 30 and the two nuts 32. The engaging means may also include the open and closed rivet nuts 100 and 102, the set screws 36, the rubber pads 38. With the panel 20 on the outside of the wall of the house and the installation bars 24 on the inside of the wall of the house, the engaging means facilitates movement of the installation bars 24 towards the panel 20 to engage the wall therebetween by manually moving the installation bar 24 towards the panel, by rotating the nuts 32 relative to the threaded rods manually, by a hand tool or the like, or by any other suitable means. The engaging means may include any other suitable components and structure in accordance with other embodiments of the present disclosure.

The assembly 10 in accordance with the present disclosure may be secured to enclose the window opening 12, for example, as follows. The installer or assembler selects the appropriate size of the panel 20 to be employed depending upon the size of the window opening 12. One of the mounting bars 22 is secured on the back 44 of the face 40 of the panel 20 by positioning the mounting bar 22 within the cavity 70 defined by the panel 20, rotating the set screws 36 to engage the back 44 of the panels 20 and engaging the engagement tabs 60 of the panel 20 with the transverse slots 110 of the mounting bar 22 at the desired location along the engagement tabs 60 of the panel 20. In positioning the mounting bar 22, the mounting bar may be first positioned at an angle with the cavity 70 and then rotated such that the slots 110 receive the tabs 60. This step of engaging the mounting bar 22 is repeated with the other mounting bar. The two pairs of threaded rods 30 are then received by the slots 140 and threadingly engaged with the closed rivet nuts 102 to secure the threaded rods to the mounting bars 22. The number and construction of the slots 140 and closed rivet nuts 102 provides alternative locations for securement. The panel 20, with the mounting bars 22 and threaded rods 30 secured thereto, is positioned about the window opening 12 on the outside of the house. Inside the house one installation bar 24 is then engaged with a pair of the threaded rods 30 and positioned adjacent the wall inside the house. A pair of the washers 34 and tamper proof nuts 32 are then used to secure one installation bar 24 to one of the mounting bars 22 as the panel 20 and installation bar 24 clamp on to the wall, with the panel 20 being outside the house and the installation bar 24 being inside the house. The tamper proof nuts 32 advance the installation bars 24 toward the back 44 of the face 40 of the panel 20 by hand or by any suitable hand tool or other tool or means. The rubber pads 38 are disposed between the ends of the installation bar 24 and the wall to protect or reduce damage to the inside of the wall. The other installation bar 24 is secured to the other mounting bar 22 in the same manner.

Figure 13:
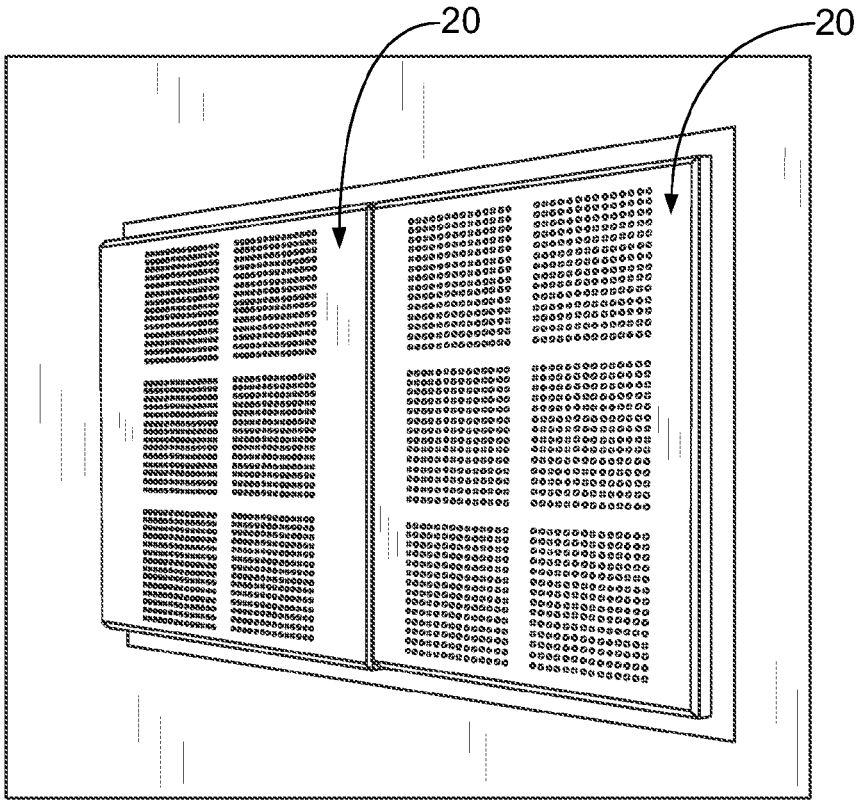
FIG. 13 is a perspective view of a pair of panels of FIG. 1 secured in a side-by-side manner.

One or more panels 20 also can be secured side by side or one above the other in a secure manner by securing the panels 20 immediately together (see FIG. 13). The outer walls of the of lateral and longitudinal sides 50 and 52 define holes 150 that can be aligned in adjacent panels 20 for receiving screws or other fasteners therethrough to lock the panels 20 together.

The assembly 10 in accordance with the present disclosure can be used to securely enclose a window of a house as illustrated in FIG. 1. The assembly 10 may be used to securely enclose door or other openings of the house depending upon the structure surrounding the opening. Further the assembly 10 can be used to securely enclose a window or door opening or other opening of any other building, including for example, any type of home, dwelling, town home, apartment, high rises, etc. and any type of commercial or other building, including stores, offices, factories, high rises, etc.

The assembly 10 of the present disclosure is relatively easy and cost effective to manufacture and is extremely reliable in protecting entry into a building. The assembly 10 can be installed quickly and efficiently. The assembly 10 also does not damage the structure and also can be quickly and efficiently removed. The assembly provides improved security because, among other reasons, the mounting bars 22 are within the cavity 70 of the panel 20 and there is no hardware outside the house. Additionally, when installed, the panels 20 are aesthetically pleasing, especially as compared to wooden window boards that are commonly used in an effort to secure window or door openings.

The present disclosure also includes a method for installing the panel 20 to the wall or other structure of the house or other building to securely enclose the window opening 12 or other opening in accordance with the disclosure set forth above. For example, the method may include securing the mounting bars 22 to the panel 20 adjacent the back 44 of the panel 20; securing the installation bars 24 to the mounting bars 22 with the threaded rods 30 received by slots of the mounting bars 22 and the installation bars 24 so that the panel 20 is on one side of the wall and the installation bar 24 is on the other side of the wall; and moving the installation bar 24 toward the panel 20 until the wall is engaged by the panel 20 and the installation bar 24 between the panel 20 and the installation bar 24 to substantially cover the window opening 12. The method may include securing the mounting bar 22 to the panel 20 as described above or in any other manner.

While embodiments have been illustrated and described in the drawings and foregoing description, such illustrations and descriptions are considered exemplary and not restrictive in character, it being understood that only illustrative embodiments have been shown and described and that all changes and modifications that come within the spirit of the invention are desired to be protected. There are a plurality of advantages of the present disclosure arising from various features set forth in the description. It will be noted that alternative embodiments of the disclosure may not include all of the features described yet still benefit from at least some of the advantages of such features. Those of ordinary skill in the art may readily devise their own implementations of the disclosure and associated methods, without undue experimentation, that incorporate one or more of the features of the disclosure and fall within the spirit and scope of the present disclosure.

What we claim:

1. An assembly for securely enclosing an opening defined by a structure of a building comprising:

a panel sized to substantially cover the opening and engage the structure, the panel having a face having a front and a back and a pair of sides defining a cavity and a pair of internal rims within the cavity;

a first mounting bar for securing to the panel;

a first installation bar for securing to the first mounting bar;

means for engaging the panel and the structure to securely enclose the opening, the engaging means configured to secure together the first mounting bar and the first installation bar and to facilitate movement of the first installation bar toward the back of the panel to engage and secure the structure between the first installation bar and the panel;

wherein the first mounting bar includes a pair of ends and the engaging means includes a first plurality of engagement tabs formed on one of the internal rims for securing the first mounting bar adjacent one of its ends to said one of the internal rims within the cavity at a selected position and a second plurality of engagement tabs formed on the other of the internal rims for securing the mounting bar adjacent the other of its ends to the other of the internal rims within the cavity at a selected position.

2. The assembly of claim 1 wherein the first mounting bar defines a first mounting bar hole and the first installation bar defines a first installation bar hole configured to align with the first mounting bar hole, the engaging means comprising a rod for extending through the first mounting bar and installation bar holes.

3. The assembly of claim 1 wherein the first mounting bar defines a pair of first mounting bar holes and the first installation bar defines a pair of installation bar holes configured to align with the first mounting bar holes, the engaging means comprising a pair of threaded rods for extending through pairs of first mounting bar and installation bar holes and a pair of nuts disposed on the threaded rods for securing together the first mounting and installation bars.

4. The assembly of claim 1 wherein the engaging means further comprises a pair of set screws for securing the mounting bar to the panel before moving the installation bars toward the back of the face of the panel, the set screws configured to extend from the mounting bar and engage the back of the face of the panel.

5. The assembly of claim 1 wherein the pair of sides of the panel are substantially parallel to each other.

6. The assembly of claim 1 wherein when the panel is secured to the structure the face of the panel defines an outside of the building and an inside of the building, the front of the panel facing the outside of the building and the back of the panel facing the inside of the building, the first mounting bar being disposed entirely inside of the building.

7. The assembly of claim 1 further comprising:

a second mounting bar for securing to the panel;

a second installation bar for securing to the second mounting bar;

wherein the engaging means is configured to secure together the second mounting bar and the second installation bar and to facilitate movement of the second installation bar toward the back of the panel to engage and secure the structure between the second installation bar and the panel.

8. The assembly of claim 7 wherein the first and second mounting bar each define mounting bar holes and the first and second installation bar each define installation bar holes configured to align with the mounting bar holes, the engaging means comprising a plurality of threaded rods, each threaded rod for extending through a respective pair of aligned mounting bar and installation bar holes.

9. The assembly of claim 7 wherein when the panel is secured to the structure the face of the panel defines an outside of the structure and an inside of the structure, the front of the panel facing the outside of the structure and the back of the panel facing the inside of the structure, the first and second mounting bars and the first and second installation bars being entirely disposed inside of the structure.

10. The assembly of claim 1 wherein the installation bar includes an elongated securing member, a pair of elongated walls disposed about the elongated securing member, a pair of flanges disposed about the elongated walls and a pair of elongated radius potions interconnecting a respective one of the elongated walls and a respective one of the flanges, the pair of radius portions engaging the structure when the panel is secured to the structure.

11. The assembly of claim 1 wherein the engaging means further comprises a pair of pads, each pad configured to be disposed between the installation bar and the structure when the panel is secured to the structure.

12. The assembly of claim 1 wherein the panel includes a pair of angled surfaces, each angled surface interconnecting the face and a respective side.

13. The assembly of claim 1 wherein the panel further includes an other pair of sides extending generally perpendicular to the pair of sides, each side and each other side having a pair of ends, each end of each side welded to a respective end of a respective other side.

14. The assembly of claim 13 wherein the panel includes a plurality of contact surfaces forming a perimeter for contacting the structure, each contact surface disposed along a respective one of the sides and other sides and having a pair of ends, each end of each contact surface welded to a respective end of one of the other contact surfaces.

15. The assembly of claim 1 wherein the panel further includes a pair of other sides extending generally perpendicular to the pair of sides and wherein the panel includes a plurality of angled members, each angled member interconnecting the face and a respective one of the sides and a respective one of the other sides.

16. The assembly of claim 1 wherein the panel further includes a contact surface disposed along each of the sides of the panel and spaced from the panel, the contact surfaces contacting the structure when the panel is secured to the structure.

17. The assembly of claim 16 wherein the panel comprises a cold rolled steel sheet.

18. The assembly of claim 16 wherein one of the internal rims extends along one side of the panel and the other internal rim extends along the other side of the panel.

19. The assembly of claim 18 wherein the contact surfaces interconnect the internal rims and the respective sides of the panel.

20. The assembly of claim 19 wherein the first plurality of engagement tabs are formed on said one internal rim and the second plurality of engagement tabs are formed on said other internal rim.

21. The assembly of claim 20 wherein said one end of the first mounting bar defines a slot for engaging one of the engagement tabs of the first plurality of engagement tabs at the selected position along said one of the sides of the panel and said other end of the first mounting bar defines a slot for engaging one of the engagement tabs of the second plurality of engagement tabs at the selected position along a length of the other internal rim.

22. The assembly of claim 1 comprising a plurality of the panels, each panel defining holes for receiving fasteners so that one of the panels may be secured to and immediately adjacent one of the other panels.

23. The assembly of claim 1 wherein the panel defines holes to allow light to pass through the panel.

24. An assembly for securely enclosing an opening defined by a structure of a building comprising:

a panel sized to substantially cover the opening and engage the structure, the panel having a face having a front and a back and a pair of sides defining a cavity;

a plurality of mounting bars configured to be received by the cavity for securing to the panel, each mounting bar defining a plurality of spaced slots;

a plurality of installation bars for securing to the mounting bars, each installation bar defining a plurality of spaced slots configured to align with the slots of the mounting bars;

a plurality of rods receivable by the aligned slots and a plurality of nuts engageable with the rods, the rods and nuts for securing each of the mounting bars to a respective installation bar and for facilitating movement of the installation bars toward the back of the face of the panel to engage and secure the structure between the panel and the installation bars;

a first plurality of engagement tabs formed on the panel for securing the panel to an end of one mounting bar and to an end of an other mounting bar within the cavity at a selected position and a second plurality of engagement tabs formed on the panel for securing the panel to an other end of said one mounting bar and to an other end of the other mounting bar within the cavity at a selected position.

25. The assembly of claim 24 further comprising a plurality of set screws for securing the mounting bars to the panel before moving the installation bars toward the back of the face of the panel.

26. The assembly of claim 24 wherein when the panel is secured to the structure the face of the panel defines an outside of the building and an inside of the building, the front of the panel facing the outside of the building and the back of the panel facing the inside of the building, the mounting bars being disposed entirely inside of the building.

* * * * *